US006386891B1

(12) United States Patent
Howard et al.

(10) Patent No.: US 6,386,891 B1
(45) Date of Patent: May 14, 2002

(54) MULTIPORT ASSEMBLY HAVING A FLOATING ELECTRICAL CIRCUIT BOARD WITHIN AN ENCLOSURE ASSEMBLY

(75) Inventors: Carol A. Howard, Oxford; Ward E. Strang, Fairfield, both of CT (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/749,695

(22) Filed: Dec. 28, 2000

(51) Int. Cl.[7] ..... H01R 12/00
(52) U.S. Cl. ..... 439/76.1; 439/731
(58) Field of Search ..... 439/687, 76.1, 439/77, 731

(56) References Cited

U.S. PATENT DOCUMENTS

| | | | | | |
|---|---|---|---|---|---|
| 3,168,613 | A | | 2/1965 | Palmer | 174/65 R |
| 3,873,889 | A | * | 3/1975 | Leyba | 361/728 |
| 3,952,903 | A | | 4/1976 | Sanders et al. | 220/4.24 |
| 4,392,701 | A | * | 7/1983 | Weidler | 439/76.1 |
| 4,652,969 | A | | 3/1987 | Stegenga | 361/694 |
| 5,111,362 | A | | 5/1992 | Flamm et al. | 361/736 |
| 5,348,482 | A | * | 9/1994 | Rudy, Jr. et al. | 439/61 |
| 5,362,243 | A | * | 11/1994 | Huss et al. | 439/76 |

* cited by examiner

*Primary Examiner*—Tulsidas Patel
(74) *Attorney, Agent, or Firm*—Marcus R. Mickney; Mark S. Bicks; Alffred N. Goodman

(57) ABSTRACT

A multiport assembly has an electrical circuit board that floats within an enclosure assembly, thereby reducing the tolerance variation and providing a multiport assembly that is easy to assemble. The enclosure assembly has a first housing cover that has a first plurality of recesses and a second housing cover that has a second plurality of recesses. The second housing cover mates with the first housing cover, thereby creating the enclosure assembly. A plurality of openings are formed in the enclosure assembly by the alignment of the first plurality of recesses with the second plurality of recesses when the first and second housing covers are mated. Brass shells are connected to the electrical circuit board that is disposed within the enclosure assembly. Each shell extends through one of the plurality of openings in the enclosure assembly for supporting the electrical circuit board in a position spaced from the enclosure assembly so that the electrical circuit board floats within the enclosure assembly.

36 Claims, 4 Drawing Sheets

MULTIPORT ASSEMBLY HAVING A FLOATING ELECTRICAL CIRCUIT BOARD WITHIN AN ENCLOSURE ASSEMBLY

FIELD OF THE INVENTION

The invention relates to a multiport assembly for an electrical circuit board. More particularly, the invention relates to a multiport assembly including an enclosure assembly for a printed circuit board having two substantially identical housing covers, and in which the electrical circuit board floats within the enclosure assembly. An electrical circuit board is placed in a first housing cover, with brass shell input and output connections, coupled to the electrical circuit board, resting on recesses in the first housing cover. A second housing cover is rotated 180 degrees around its longitudinal axis to mate with the first housing cover, and enclosing the electrical circuit board within the first and second housing covers. The brass shell connections support the electrical circuit board in a position spaced from the enclosure assembly. Electrical devices may then be connected to the electrical circuit board through the brass shell input and output connections.

BACKGROUND OF THE INVENTION

Enclosure assemblies are widely used to provide protective housings for electrical circuit boards. A multiport assembly includes an enclosure assembly and an electrical circuit board disposed within the assembly. A multiport assembly is used to provide power to devices, such as proximity sensors and other motion control or sensing devices. For example, in a bottling plant a sensor may be used to detect whether a bottle is missing in a line or if a bottle is not filled to a predetermined level.

Typically, the enclosure assemblies are made of several different parts, thereby requiring tooling of several parts to assemble a complete electrical circuit board enclosure assembly. Tooling costs are considerable due to the large number of unique parts that must be manufactured for each enclosure assembly. Additionally, the large number of parts required for each enclosure assembly results in a large inventory of parts.

Some enclosure assemblies are made of parts that are identical. However, those enclosure assemblies do not completely cover the electrical circuit board, or they require additional parts to completely cover the electrical circuit board. The requirement of additional parts to completely enclose the electrical circuit board increases the necessary inventory requirement.

Typically, multiport assemblies contain a single electrical circuit board having a "rat's nest" wiring scheme. Each individual wire goes directly from the electrical circuit board to an input/output insulator that resides in a brass shell connected to the electrical circuit board. The "rat's nest" wiring takes up extra space due to the numerous wires required to connect the electrical circuit board to each of the insulators and the chaotic nature of the wiring scheme. Moreover, the extra wires and the confusing wiring scheme can lead to miswiring of the electrical circuit board and a greater difficulty in assembling the multiport assembly. Additionally, use of a single circuit board allows for a large tolerance variation, which may cause difficulty in assembling the multiport assembly.

Examples of existing electrical circuit board enclosure assemblies are disclosed in the following disclosures: U.S. Pat. No. 5,111,362 to Flamm et al.; and U.S. Pat. No. 3,168,613 to Palmer.

Thus, there is a continuing need to provide improved multiport assemblies for electrical circuit boards.

SUMMARY OF THE INVENTION

Accordingly, it is a primary object to provide a multiport assembly having an electrical circuit board that floats within an enclosure assembly, thereby reducing the tolerance variation and providing a multiport assembly that is easy to assemble.

Another object of the invention is to provide a multiport assembly in which the enclosure assembly has substantially identical halves, thereby reducing tooling costs and inventory.

Another object of the invention is to provide a multiport assembly in which the electrical circuit board has a minimal amount of wires, thereby preventing miswiring and allowing for easy assembly.

The foregoing objects are basically attained by providing a multiport assembly that has a first housing cover having a first plurality of recesses; a second housing cover having a second plurality of recesses, the second housing cover mating with the first housing cover, thereby creating an enclosure assembly, the enclosure assembly having a plurality of holes formed by the alignment of the first plurality of recesses with the second plurality of recesses; an electrical circuit board disposed within the enclosure assembly, the board having first and second ends and first and second sides; and a plurality of shells connected to the electrical circuit board, each shell extending through one of the plurality of holes in the enclosure assembly and supporting the electrical circuit board in a position spaced from the enclosure assembly.

Other objects, advantages and salient features of the invention will become apparent from the following detailed description, which, taken in conjunction with the annexed drawings, discloses preferred embodiments of the invention.

DRAWINGS

Referring now to the drawings that form a part of the original disclosure:

DETAILED DESCRIPTION OF THE INVENTION

Figure 1:
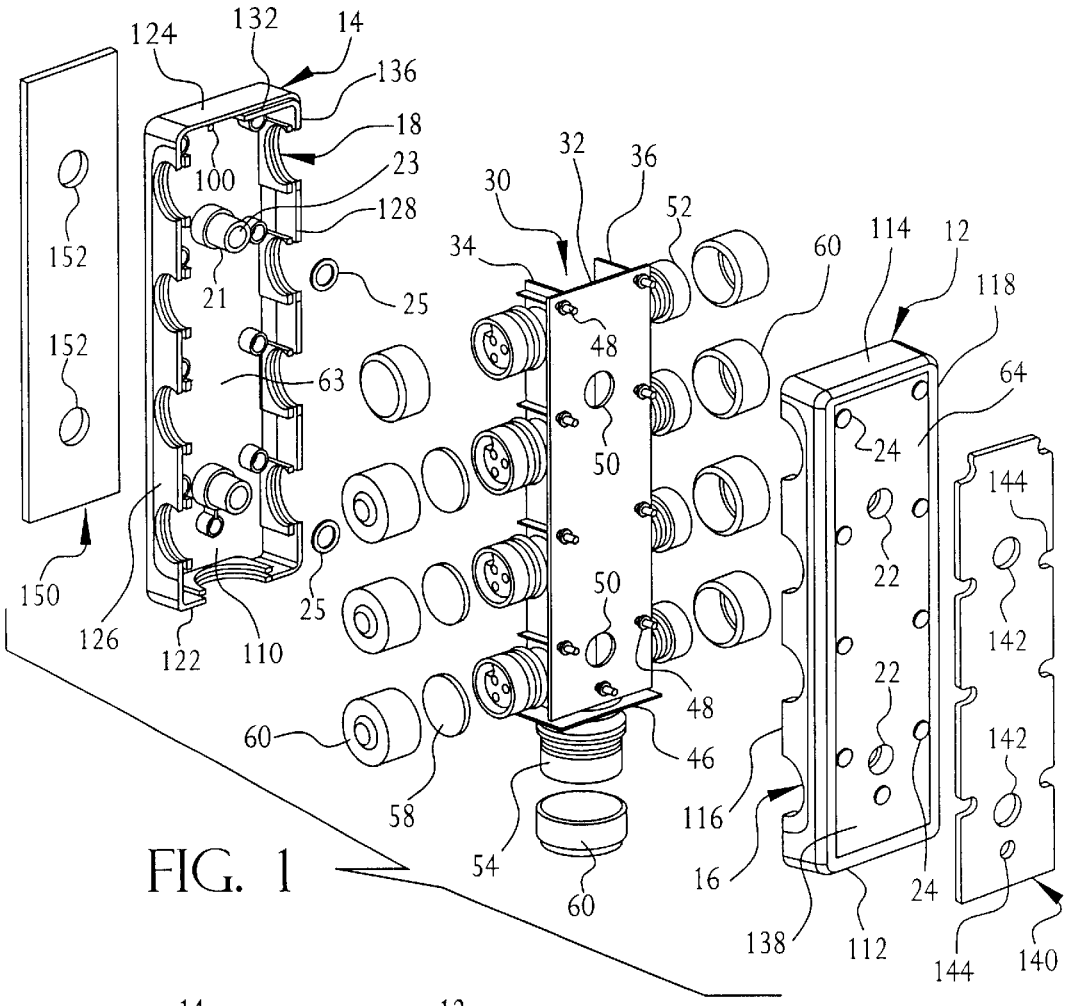
FIG. 1 is an exploded, perspective view of the multiport assembly, including first and second housing covers, an electrical circuit board, and brass shells for input and output connections.
Figure 2:
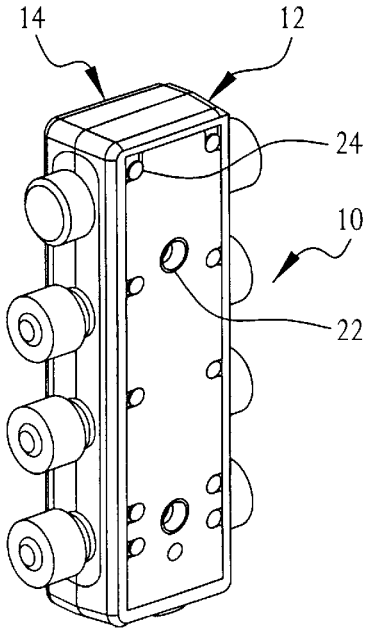
FIG. 2 is a perspective view of the multiport assembly shown in FIG. 1 fully assembled.

FIGS. 1 and 2 show a multiport assembly 10 of the present invention. The multiport assembly includes an enclosure assembly 28 and an electrical circuit board 30. As seen in FIGS. 1 and 2, multiport assembly 10 in accordance with the invention comprises a first housing cover 12 having a first plurality of recesses 16, a second housing cover 14 having a second plurality of recesses 18, an electrical circuit board 30 disposed within the enclosure assembly, and a plurality of shells coupled to the electrical circuit board. The second housing cover mates with the first housing cover, thereby creating the enclosure assembly 28. The enclosure assembly 28 has a plurality of holes 26 formed by the alignment of the first plurality of recesses 16 with the second plurality of recesses 18 when the first housing cover 12 and second housing cover 14 are mated. Each shell extends through one of the holes 26 in the enclosure assembly 28, as shown in FIG. 2, and supports the electrical circuit board 30 inside of but in a position physically spaced from the enclosure assembly.

Figure 3:
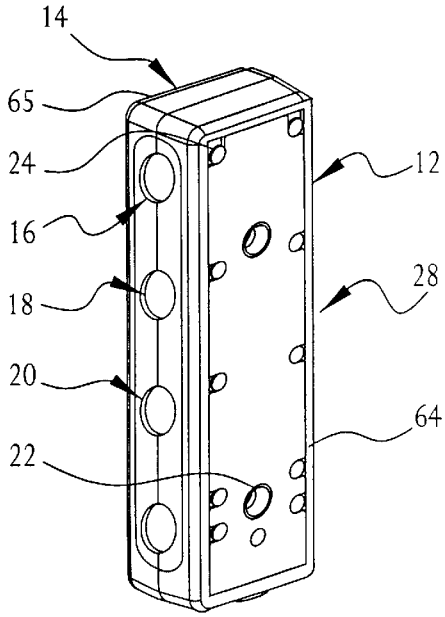
FIG. 3 is a perspective view of two mated housing covers without an electrical circuit board disposed therein.
Figure 4:
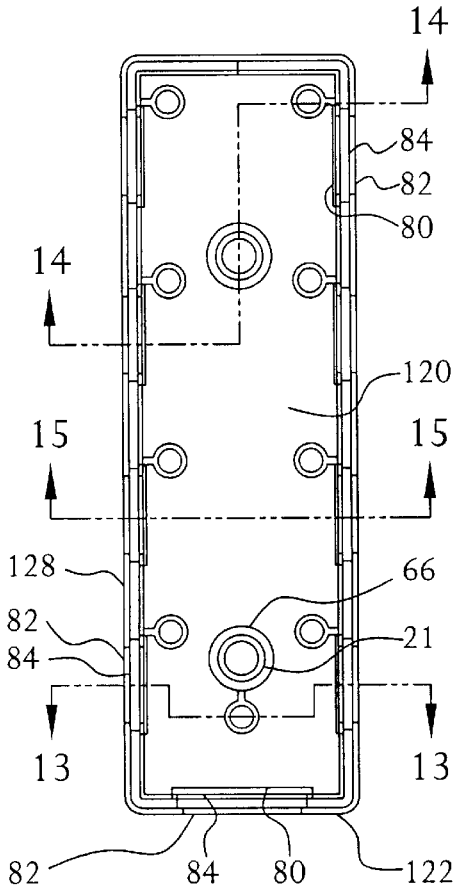
FIG. 4 is a top plan view of the inside of a housing cover.
Figure 5:
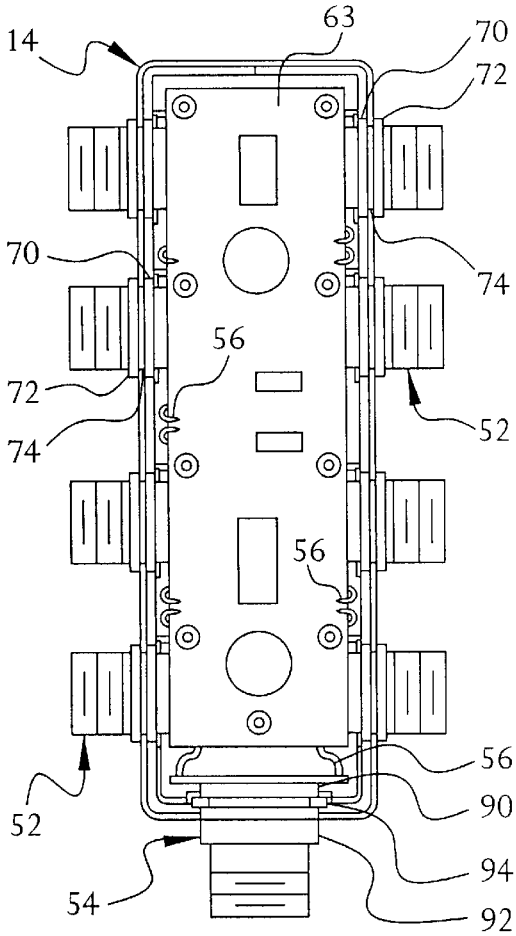
FIG. 5 is a top plan view of an electrical circuit board disposed within a housing cover showing the electrical circuit board floating within the cover.
Figure 6:
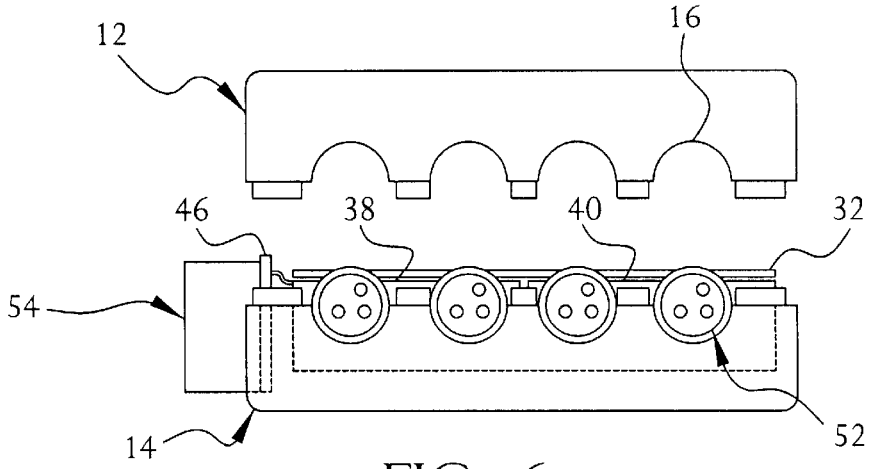
FIG. 6 is a side elevational view of an electrical circuit board disposed within a first housing cover and a second housing cover about to mate with the first housing cover to enclose the electrical circuit board.

The first housing cover 12 and the second housing cover 14 are shown in FIGS. 1 and 3. Preferably, the first housing cover 12 and the second housing cover 14 are substantially identical. Each of the first and second housing covers 12 and 14 has a base 110 and 120 having an inner surface 62 and 63 and an outer surface 64 and 65, as shown in FIGS. 1, 4, 5 and 8–15. Extending perpendicularly from the bases 110 and 120 of the first housing cover 12 and second housing cover 14 are front walls 112 and 122, rear walls 114 and 124, and side walls 116, 118, 126 and 128. Each of the walls has an inner layer 130 and 134 and an outer layer 132 and 136, as shown in FIGS. 4, 5 and 6. For one half of the perimeter of the walls, the outer layer extends beyond the inner layer, thereby creating an overhang portion with the outer layer and a shelf portion with the inner layer. For the other half of the perimeter of the walls, the inner layer extends beyond than the outer layer, thereby creating an overhang portion with the inner layer and a shelf portion with the outer layer. This configuration allows the first housing cover to mate with the second housing cover when the first housing cover is rotated 180 degrees about its longitudinal axis. The overhang portion of one housing cover mates with the corresponding shelf area of the other housing cover, thereby allowing the two housing covers to mate. Furthermore, adhesive may be used for a stronger connection between the first and second housing covers.

The first housing cover has a plurality of openings 24 through which LED's mounted on the electrical circuit board can pass. A snug fit exists between the LED's and the first housing cover. Plugs are inserted in a housing cover mold during the manufacturing process to produce a second housing cover 14 that does not have LED openings.

Mounting posts 20 and 21 extend from inner surfaces 62 and 63 of the housing covers 12 and 14. Mounting holes 22 and 23 extend through each of the housing covers 12 and 14 and mounting posts 20 and 21. A gasket 25 may be positioned between ends of the mounting posts when the first and second housing covers are mated to provide a seal between the posts, which prevents potting compound from entering the mounting posts through the mounting holes when the multiport assembly is filled with the potting compound.

The first housing cover 12 has a first plurality of recesses 16 and the second housing cover 14 has a second plurality of recesses 18. Preferably, as shown in FIGS. 1 and 6, the recesses have a semi-circular shape so that when the first housing cover 12 and the second housing cover 14 are joined together, as shown in FIG. 3, a series of circular holes 26 are formed. Each of the recesses 16 in the first housing cover 12 has an inner lip 81 and an outer lip 83 separated by a groove 85. Each of the recesses 18 in the second housing cover 14 has an inner lip 80 and an outer lip 82 separated by a groove 84. Preferably, each side wall 116, 118, 126 and 128 of both of the housing covers 12 and 14 has four recesses, and each front wall 112 and 122 has one recess.

Conventional fasteners (not shown) inserted through the mounting holes 22 and 23 securely mount the multiport assembly 10 in position, such as on a wall. A shoulder 66 and 67 within each of the mounting holes 22 and 23 allows fasteners to be fully inserted within the mounting holes such that the head of a fastener does not extend beyond the outer surface 64 of the first housing cover 12.

A recessed area 138 in the first housing cover 12 allows a label 140 to be affixed to the outer surface 64 of the first housing cover, as shown in FIG. 1, for identification of the multiport assembly 10. A recessed area (not shown) in the second housing cover 14 allows a second label 150 to be affixed to the outer surface 65 of the second housing cover. The label 140 for the first housing cover 12 has mounting holes 142 corresponding to the mounting holes of the first housing cover. The label 140 also has cut-out sections 144 corresponding to the LED's 48, so that the visibility of the LED's is not impeded. The label 150 for the second housing cover 14 has mounting holes 152 corresponding to the mounting holes of the second housing cover.

Preferably, each of the housing covers is unitarily formed as one piece of material. Preferably, the housing cover is made of plastic, such as polyvinyl chloride.

Figure 7:
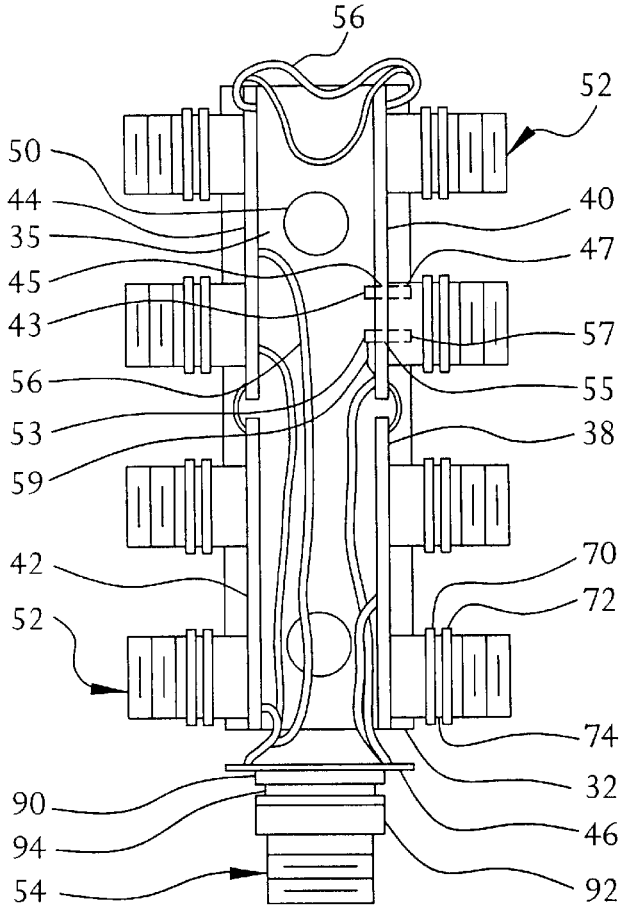
FIG. 7 is a bottom plan view of an electrical circuit board and wiring.
Figure 8:
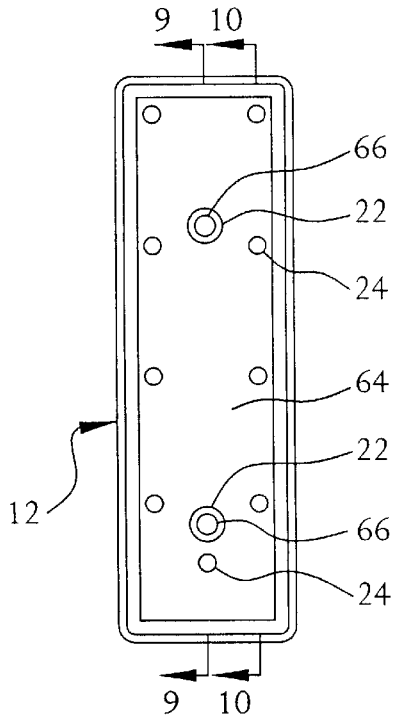
FIG. 8 is a bottom plan view of a housing cover.
Figure 9:
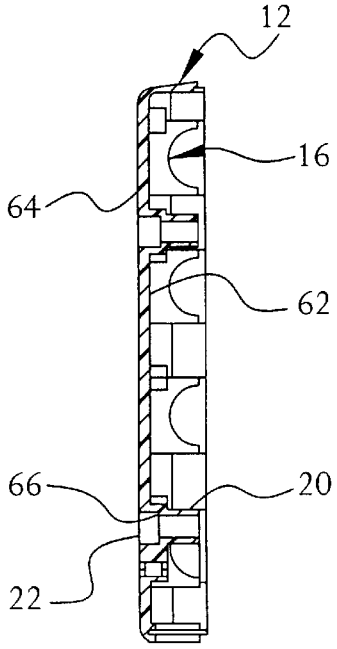
FIG. 9 is a right side elevational view in cross-section of a housing cover, taken along line 9—9 of FIG. 8.
Figure 10:
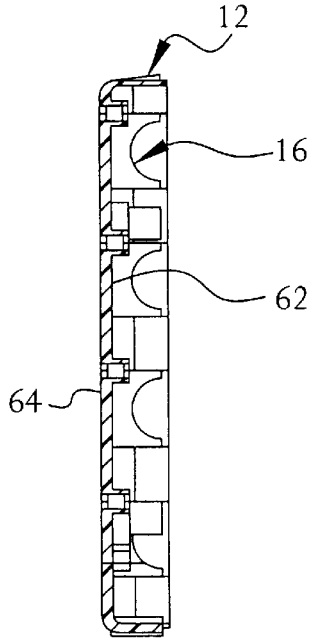
FIG. 10 is a right side elevational view in cross-section of a housing cover, taken along line 10—10 of FIG. 8.
Figure 11:
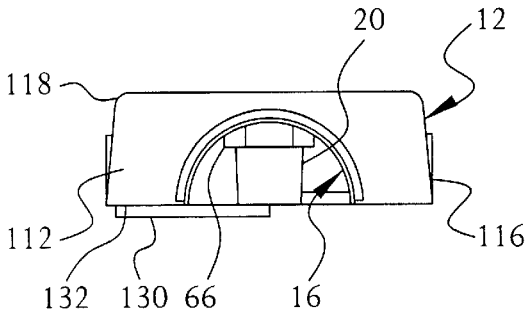
FIG. 11 is a front elevational view of a housing cover.
Figure 12:
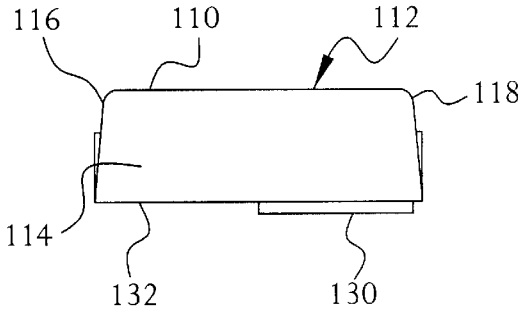
FIG. 12 is a rear elevational view of a housing cover.
Figure 13:
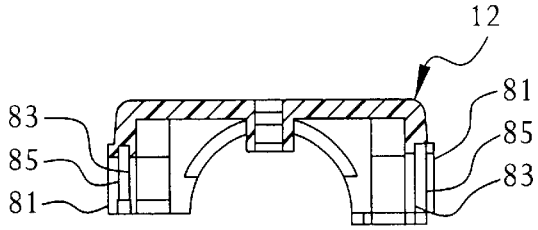
FIG. 13 is a rear elevational view in cross-section of a housing cover, taken along line 13—13 of FIG. 4.
Figure 14:
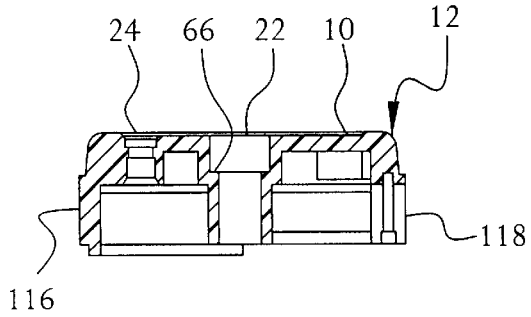
FIG. 14 is a front elevational view in cross-section of a housing cover, taken along line 14—14 of FIG. 4.
Figure 15:
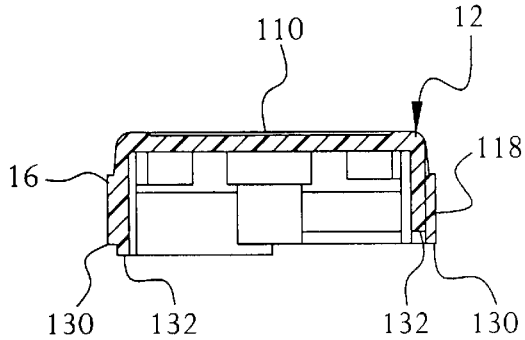
FIG. 15 is a front elevational view in cross-section of a housing cover, taken along line 15—15 of FIG. 4.

An electrical circuit board 30 is shown in FIGS. 1 and 7. Preferably, the electrical circuit board is a printed electrical circuit board. Preferably, the electrical circuit board comprises a main board 32, a first side board 34, a second side board 36 and an end board 46, each of which is substantially planar and rigid. Preferably, the first side board 34 and the second side board 36 are both made of two side boards 38 and 40, and 42 and 44, respectively. The boards are physically and electrically connected to each other by wires 56, as shown in FIG. 7.

LED's 48 may be mounted to an upper surface 33 of the main board 32. Mounting holes 50 in the main board 32 allow the mounting posts 20 of the first housing cover 12 to pass through the board when the first housing cover and second housing cover 14 are joined together.

A plurality of substantially cylindrical brass shells 52 and 54 are connected to the electrical circuit board 30. The brass shells are rigidly connected to the end board 46 and to the side boards 34 and 36. As seen in FIG. 7, for example pins 43 and 53 are inserted into holes 47 and 57 within each brass shell. The pins 43 and 53 are also inserted into holes 45 and 55 and in an electrical circuit board. A printed circuit 59 may connect a pin 53 to an electrical wire 56. The pins 43 and 53 serve as both a mechanical and an electrical connection between each shell and the board to which it is connected. Preferably, each side board 34 and 36 has two side boards 38 and 40, and 42 and 44. Each of the side boards 38, 40, 42, and 44 has two brass shells rigidly connected to each board for a total of nine shells. The brass shells 52 connected to the side boards 38, 40, 42 and 44 are electrical outputs. The brass shell 54 connected to the end board 46 is an electrical input. A gasket 58 and a cap 60 may be used to cover an unused shell when the multiport assembly is placed in service.

Wires 56 are used to physically and electrically connect all the boards together, rather than connecting wires directly to the brass shells. Wiring the boards together allows for a simple wiring scheme, rather than the rat's nest wiring scheme required to wire the boards to each of the shells. Since a simple wiring scheme may be used, miswiring the boards is avoided and assembling the multiport assembly is easy. Printed circuits on the boards provide an electrical pathway between where a wire is connected to an electrical circuit board and where a pin within a shell is connected to an electrical circuit board.

The an input brass shell 54 has an inner 90 ring and an outer ring 92 separated by a groove 94, as shown in FIGS. 5 and 7, for facilitating mating of the input shell with the recess 18 in the second housing cover 14. An output brass shell 52 has an inner ring 70 and an outer ring 72 separated by a groove 74, as shown in FIGS. 5 and 7, for facilitating mating of the output shell with the recess 18 in the second housing cover 14. Preferably, the end of the input brass shell 52 and the ends of the output brass shells 54 are threaded for receiving electrical connections. As shown in FIG. 1, the output shells (54) have three pin connections each and the input shell 52 has twelve pins (not shown). The present invention is not limited to this pin configuration.

The brass shells 52 and 54 support the electrical circuit board 30 when it is inserted in the second housing cover 14, thereby allowing the electrical circuit board to float, i.e., there is no direct physical contact between the electrical circuit board and the inner surfaces of the enclosure assembly 28. Floating the electrical circuit boards provides a multiport assembly that is easier to assemble. Since the brass shells are in fixed locations on the electrical circuit board, allowing the boards to float aids in locating and properly seating the brass shells in the holes 26. Additionally, having two side boards on each side of the main board decreases the tolerance variation in the electrical circuit board over having one side board on each side of the main board.

ASSEMBLY AND DISASSEMBLY

A fully assembled multiport assembly 10 is shown in FIG. 2. The multiport assembly is constructed by assembling the various parts as shown in FIG. 1.

The electrical circuit board 30 is inserted into the second housing cover 14, such that the brass shells 52 and 54 are resting in the recesses 18 in the second housing cover. The inner rings 70 of the output shells rest in grooves 84 in the recesses 18, as shown in FIG. 5. The grooves 74 on the output shells 52 receive outer lips 80 of the second housing cover recesses 18. The outer rings 72 of the output shells 52 are positioned against the outer edge of the outer lips 80 of the second housing cover recesses 18. The inner ring 90 of the input shell 54 is aligned with the inner lips 80 and 81 of the second housing cover 14. The groove 94 of the input shell 54 is aligned with the groove 84 of the second housing cover 14. The outer ring 92 of the input shell 54 is aligned with the outer lip 82 of the second housing cover 14.

The first housing cover 12 is rotated 180 degrees about its longitudinal axis and placed on the second cover housing 14 such that the first plurality of recesses 16 are aligned with the second plurality of recesses 18. The first plurality of recesses mate with the brass shells 52 and 54 that are already positioned in the second housing cover, as shown in FIG. 6. The outer lip 83 of the first housing cover 12 is received by grooves 74 in the output shells 52. The grooves on the first housing cover 12 receive inner rings 70 of the output shells 52. The outer rings 72 of the output shells 52 are positioned against the outer edge of the outer lips 80 of the first plurality of recesses 16. The inner lip 81 of the first housing cover 12 is aligned with the inner ring 90 of the input shell 54. The groove 85 of the first housing cover 12 is aligned with the groove 94 of the input shell 54. The outer lip 83 of the first housing cover 12 is aligned with the outer ring 92 of the input shell 54. Therefore, the electrical circuit board 30 floats within the enclosure assembly 28.

The overhanging portions of one housing cover mate with the corresponding shelf portions of the other housing cover, thereby forming an enclosure assembly around the electrical circuit board 30.

Once the multiport assembly 10 has been assembled, its interior cavity is filled with a potting compound through an opening 100 in one of the housing covers. Preferably, the potting opening 100 is in the second housing cover 14. Potting compound protects sensitive electronic components from impact, shock, vibration, heat, conductivity, moisture, chemicals, and visual inspection. The potting compound is injected through the opening 100 in the second housing cover 14 until the enclosure assembly 28 is completely filled with the compound. More than one opening may be used for injecting the potting compound so that the compound is injected more evenly within the enclosure assembly and to fill the enclosure assembly more quickly. A gasket 25 between mounting posts 20 and 21 of the first and second housing covers prevents potting compound from entering the posts through the mounting holes. The LED's have a snug fit within the LED openings in the first housing cover, and therefore the potting compound is also prevented from entering the LED opening and interfering with the visibility of the LED's.

Once the multiport assembly 10 has been filled with potting compound, labels 140 and 150 may be affixed to the first and second housing covers, respectively. The label 140 for the first housing cover 12 has cut-out sections 144 so that visibility of the LED's is not affected.

Finally, fasteners are inserted through the mounting holes for securely mounting the multiport assembly in a desired location. A recessed shoulder 66 in the mounting hole 22 in the first housing cover 12 allows the fastener to be completely received within the mounting hole so that no portion of the fastener extends beyond the outer surface 64 of the first housing cover.

While advantageous embodiments have been chosen to illustrate the invention, it will be understood by those skilled in the art that various changes and modifications may be made therein without departing from the scope of the invention as defined in the appended claims.

What is claimed is:

1. A multiport assembly, comprising:

a first housing cover having a first plurality of recesses;

a second housing cover having a second plurality of recesses, said second housing cover mating with said first housing cover, thereby creating an enclosure assembly, said enclosure assembly having a plurality of openings formed by the alignment of said first plurality of recesses with said second plurality of recesses;

a first electrical circuit board disposed within said enclosure assembly, said board having first and second ends and first and second sides;

at least one second electrical circuit board disposed within said enclosure assembly and connected to said first electrical circuit board; and a plurality of shells connected to said first and said at least one second electrical circuit boards, each shell extending through one of said plurality of openings in said enclosure assembly and supporting said first and said at least one second electrical circuit boards in a position spaced from said enclosure assembly.

2. The assembly of claim 1, wherein said at least one second electrical circuit board comprises a first side board positioned substantially perpendicular to said first side of said electrical circuit board, a second side board positioned substantially perpendicular to said second side of said electrical circuit board;

an end board positioned substantially perpendicular to said first end of said electrical circuit board; and wiring for electrically connecting said electrical circuit board, said first and second side boards, and said end board.

3. The assembly of claim 2, wherein each of first and second side boards comprises two boards.

4. The assembly of claim 1, wherein said first and second housing covers are made of plastic.

5. The assembly of claim 1, wherein said first and second housing covers are made of polyvinyl chloride.

6. The assembly of claim 1, wherein said first housing cover has a plurality of holes for receiving a plurality of LED's mounted on said electrical circuit board.

7. The assembly of claim 1, wherein said shells are made of brass.

8. The assembly of claim 1, wherein said plurality of shells comprises nine shells.

9. The assembly of claim 1, wherein said first and said at least one second electrical circuit boards are printed electrical circuit boards.

10. The assembly of claim 1, wherein said second housing cover is substantially identical to said first housing cover.

11. A multiport assembly, comprising:

a first housing cover having a first plurality of recesses;

a second housing cover having a second plurality of recesses, said second housing cover mating with said first housing cover, thereby creating an enclosure assembly, said enclosure assembly having a plurality of openings formed by the aligning of said first plurality of recesses with said second plurality of recesses;

an electrical circuit board assembly disposed within said enclosure assembly, said board assembly comprising a main board having first and second ends and first and second sides, first and second side boards positioned substantially perpendicular to opposite sides of said main board, an end board positioned substantially perpendicular to said first end of said main board, and wiring for electrically connecting said first and second side boards, said end board and said main board; and a plurality of shells connected to said first and second side boards and to said end board, each shell extending through one of said plurality of openings in said enclosure assembly and supporting said electrical circuit board in a position spaced from said enclosure assembly.

12. The assembly of claim 11, wherein said first and second housing covers are made of plastic.

13. The assembly of claim 11, wherein said first and second housing covers are made of polyvinyl chloride.

14. The assembly of claim 11, wherein said first housing cover has a plurality of holes for receiving a plurality of LED's mounted on said board assembly.

15. The assembly of claim 11, wherein said shells are made of brass.

16. The assembly of claim 11, wherein said plurality of shells comprises nine shells.

17. The assembly of claim 11, wherein four shells are coupled to each of said first and second side boards, and one shell is coupled to said end board.

18. The assembly of claim 11, wherein each of said first and second side boards comprises two boards.

19. The assembly of claim 11, wherein said electrical circuit board is a printed electrical circuit board.

20. The assembly of claim 11, wherein said second housing cover is substantially identical to said first housing cover.

21. A multiport assembly, comprising:

a first housing cover having a first plurality of recesses;

a second housing cover having a second plurality of recesses, said second housing cover mating with said first housing cover, thereby creating an enclosure assembly, said enclosure assembly having a plurality of openings formed by the alignment of said first plurality of recesses with said second plurality of recesses;

a printed circuit board assembly disposed within said enclosure assembly, wherein said board assembly comprises a main board having first and second ends and first and second sides, first and second side boards positioned substantially perpendicular to said first side of said board, third and fourth side boards positioned substantially perpendicular to said second side of said main board, an end board positioned substantially perpendicular to said first end of said main board, and wiring for electrically connecting said first, second, third and fourth side boards, said end board and said main board; and a plurality of shells, at least one of said plurality of shells being connected to said first, second, third and fourth side boards and to said end board, each shell extending through one of said plurality of openings in said enclosure assembly and supporting said electrical circuit board in a position spaced from said enclosure assembly.

22. The assembly of claim 21, wherein said first and second covers are made of plastic.

23. The assembly of claim 21, wherein said first and second covers are made of polyvinyl chloride.

24. The assembly of claim 21, wherein said first housing cover has a plurality of holes for receiving a plurality of LED's mounted on said board assembly.

25. The assembly of claim 21, wherein said shells are made of brass.

26. The assembly of claim 21, wherein said plurality of shells comprises nine shells.

27. The assembly of claim 21, wherein two shells are coupled to each of said side boards, and one shell is coupled to said end board.

28. The assembly of claim 21, wherein said electrical circuit board is a printed electrical circuit board.

29. The assembly of claim 21, wherein said second housing cover is substantially identical to said first housing cover.

30. A multiport assembly, comprising:

a first housing cover having a first plurality of recesses;

a second housing cover having a second plurality of recesses, said second housing cover mating with said first housing cover, thereby creating an enclosure assembly, said enclosure assembly having a plurality of openings formed by the alignment of said first plurality of recesses with said second plurality of recesses;

a first electrical circuit board disposed within said enclosure assembly;

at least one second electrical circuit board disposed within said enclosure assembly and connected to said first electrical circuit board, said at least one second electrical circuit board being substantially perpendicular to said first electrical circuit board; and a plurality of shells connected to said at least one second electrical circuit board, each shell extending through one of said plurality of openings in said enclosure assembly and supporting said first and at least one second electrical circuit boards in a position spaced from said enclosure assembly.

31. The assembly of claim 30, wherein said first and second housing covers are made of plastic.

32. The assembly of claim 30, wherein said first and second housing covers are made of polyvinyl chloride.

33. The assembly of claim 30, wherein said first housing cover has a plurality of holes for receiving a plurality of LED's mounted on said first electrical circuit board.

34. The assembly of claim 30, wherein said shells are made of brass.

35. The assembly of claim 30, wherein said first and at least one second electrical circuit boards are printed electrical circuit boards.

36. The assembly of claim 30, wherein said second housing cover is substantially identical to said first housing cover.

* * * * *